US010315291B2

(12) United States Patent
Wang

(10) Patent No.: US 10,315,291 B2
(45) Date of Patent: Jun. 11, 2019

(54) WRENCH

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 228 days.

(21) Appl. No.: 15/325,256

(22) PCT Filed: Jul. 11, 2014

(86) PCT No.: PCT/CN2014/082038

§ 371 (c)(1),
(2) Date: Jan. 10, 2017

(87) PCT Pub. No.: WO2016/004619

PCT Pub. Date: Jan. 14, 2016

(65) Prior Publication Data

US 2017/0157748 A1 Jun. 8, 2017

(51) Int. Cl.

| | |
|---|---|
| ***B25B 13/22*** | (2006.01) |
| ***B25B 13/12*** | (2006.01) |
| ***B25B 13/50*** | (2006.01) |

(52) U.S. Cl.

CPC ..... *B25B 13/22* (2013.01); *B25B 13/12* (2013.01); *B25B 13/5058* (2013.01)

(58) Field of Classification Search

CPC ..... B25B 13/22; B25B 13/24; B25B 13/12; B25B 13/14

See application file for complete search history.

(56) References Cited

U.S. PATENT DOCUMENTS

| | | | | |
|---|---|---|---|---|
| 539,031 A | | 5/1895 | Born | |
| 1,875,646 A | * | 9/1932 | Pasquale | B25B 13/12 81/100 |
| 1,987,353 A | * | 1/1935 | Vetrano | B25B 13/22 81/129.5 |
| 1,999,076 A | * | 4/1935 | Bauman | B25B 13/22 81/103 |

(Continued)

FOREIGN PATENT DOCUMENTS

| | | |
|---|---|---|
| CN | 1535198 A | 10/2004 |
| CN | 201856195 U | 6/2011 |

(Continued)

*Primary Examiner* — David B. Thomas
(74) *Attorney, Agent, or Firm* — The Webb Law Firm

(57) ABSTRACT

The present invention provides a wrench, and its structure includes a guide rod, a first pawl mounted on the guide rod, a sliding member sheathed on the guide rod, a second pawl mounted on the sliding member and matching with the first pawl, and a toothed block disposed on the sliding member and matching with the guide rod. The toothed block has a first position and a second position. When the toothed block is in the first position, the toothed block is slidable along the guide rod toward the first pawl, and is locked in the direction away from the first pawl. When the toothed block is in the second position, the toothed block is slidable along the guide rod toward or away from the first pawl.

23 Claims, 5 Drawing Sheets

(56) References Cited

U.S. PATENT DOCUMENTS 2,050,102 A * 8/1936 Kujala ..... B25B 13/22 81/100
2,253,895 A * 8/1941 Denovich ..... B25B 13/22 81/139
2,319,647 A * 5/1943 Vautrot ..... B25B 13/12 33/832
2,365,139 A * 12/1944 Newberry ..... B25B 13/12 81/102
2,369,346 A * 2/1945 Gearhart ..... B25B 13/18 81/356
2,420,714 A * 5/1947 Mead ..... B25B 13/22 411/960
2,437,801 A * 3/1948 Andersen ..... B25B 13/22 81/100
2,448,999 A * 9/1948 Mead ..... B25B 13/22 81/103
2,543,824 A * 3/1951 Beesley ..... B25B 13/22 81/140
2,612,808 A * 10/1952 Small ..... B25B 13/12 81/134
2,957,378 A * 10/1960 Foss ..... B25B 13/12 81/145
3,039,338 A * 6/1962 Borg ..... B05D 5/08 81/134
3,625,096 A * 12/1971 Myers ..... B25B 13/12 81/10
3,956,949 A * 5/1976 Romano ..... B25B 13/22 81/135
4,028,969 A * 6/1977 Politte ..... B25B 13/12 267/163
4,144,779 A * 3/1979 Honick ..... B25B 13/28 81/103
4,712,455 A 12/1987 Cox
5,832,793 A * 11/1998 Collins ..... B25B 13/12 81/138
6,026,716 A * 2/2000 Orlosky ..... B25B 13/5058 81/322
6,938,525 B2 9/2005 Poole et al.
8,485,073 B1 * 7/2013 Lopez ..... B25B 5/04 81/129.5
2003/0183048 A1 * 10/2003 Olsen ..... B25B 13/04 81/179
2004/0074345 A1 * 4/2004 Huang ..... B25B 13/12 81/142
2006/0196319 A1 9/2006 Hung et al.
2009/0193940 A1 8/2009 Kuo

FOREIGN PATENT DOCUMENTS

CN 102632474 A 8/2012
CN 103692390 A 4/2014
CN 203993655 U 12/2014
DE 4229221 A1 3/1994
KR 1020130123665 A 11/2013

* cited by examiner

WRENCH

CROSS-REFERENCE TO RELATED APPLICATION

This application is the United States national phase of International Application No. PCT/CN2014/082038 filed Jul. 11, 2014, the disclosure of which is hereby incorporated in its entirety by reference.

FIELD OF THE INVENTION

The invention relates to a hand tool, and, in particular, relates to a wrench used for clamping a flat plate, a nut, and especially pipe fittings such as a steel pipe, a plastic pipe, etc.

DESCRIPTION OF THE PRIOR ART

In daily lives or works, a wrench is frequently used for clamping an object, such as for clamping pipe fittings such as a steel pipe, a plastic pipe etc., to implement loosening and tightening of mounting or dismounting. A traditional wrench, such as a pipe wrench, for clamping pipe fittings is generally composed of a fixed jaw, a movable jaw, a handle, an adjusting nut, etc. The fixed jaw is fixed together with the handle in a sophisticated structure. The traditional pipe wrench accomplishes opening and closing relying on the transmission by the thread pair between the nut and the movable jaw. In use, the adjusting nut is rotated constantly to enable the change in the opening size of the movable jaw relative to the fixed jaw by adjusting the sliding movement of the movable jaw, and, therefore, the operation is very inconvenient. Meanwhile, the opening and closing speed of the jaws of a traditional pipe wrench is limited by the pitch of the thread pair, unable to realize fast opening and closing of the jaws.

SUMMARY OF THE INVENTION

In view of the above defects in the prior art, the technical problem to be solved by the invention is to provide a wrench which has simple structure, flexibility of opening and closing, fast adjusting speed, convenience and reliability in using. The wrench can be used for clamping and rotating a pipe fitting, and also for clamping objects in other shapes such as a flat plate, a nut, etc.

In order to achieve the above object, the invention provides a wrench, the structure of which comprising: a guide rod, a first pawl mounted on the guide rod, a sliding member sheathed on the guide rod, and a second pawl mounted on the sliding member and matching with the first pawl, characterized in that, the wrench further comprises a toothed block disposed on the sliding member and matching with the guide rod, the toothed block having a first position and a second position; the wrench is configured such that: when the toothed block is in the first position, the toothed block is locked; when the toothed block is in the second position, the toothed block is unlocked.

Further, the first position refers to a position where the toothed block is located when the toothed block is engaged with the guide rod; the second position refers to a position where the toothed block is located when the toothed block and the guide rod are detached.

Further, when the toothed block is in the first position, the toothed block is slidable along the guide rod toward the first pawl, and is locked in the direction away from the first pawl; when the toothed block is in the second position, the toothed block is slidable along the guide rod toward or away from the first pawl.

Further, an engagement portion where the guide rod is engaged with the toothed block is provided with unidirectional teeth having a unidirectional orienting effect: when the sliding member is pushed toward the first pawl, the toothed block is slidable along toothed surface of the unidirectional teeth, so that the sliding member moves along the guide rod and comes close to the first pawl; when the sliding member is pushed away from the first pawl, a sliding movement of the toothed block along toothed surface of the unidirectional teeth is obstructed, so that a sliding movement of the sliding member along the guide rod is locked.

Further, the sliding member is provided with a sloping surface matching with the toothed block, a first angle provided between the sloping surface and the guide rod; the first angle enabling the toothed block to be subject to an acting force perpendicular to the guide rod and pointing toward the guide rod when the wrench is clamping a workpiece, the acting force facilitating the engagement of the toothed block and the guide rod.

Further, the first angle is arranged to be less than 90°.

Further, an engagement portion where the guide rod is engaged with the toothed block is provided with unidirectional teeth having a toothed surface, the toothed surface obstructs the sliding movement of the toothed block away from the first pawl, a second angle provided between the toothed surface and the sloping surface, the second angle enabling the unidirectional teeth to still be able to lock the toothed block when the unidirectional teeth deform.

Further, the second angle is arranged to be more than 0°.

Further, a reserved space is arranged between the toothed block and the sliding member, the reserved space enabling the toothed block to rotate by an angle allowing the toothed block to conquer the locking of the toothed block with respect to the guide rod produced due to the second angle, so that the toothed block is detached from the guide rod; meanwhile, the reserved space enables a plurality of teeth on the toothed block to automatically locate position to be engaged with the guide rod.

Further, the wrench also includes a connecting rod provided at both sides of the guide rod and connected to the toothed block.

Further, the wrench also includes a pushbutton connected to the toothed block by the connecting rod, when a pressing force is applied to the pushbutton, the connecting rod being able to transfer the pressing force to the toothed block, so that the toothed block is detached from the guide rod; when the pressing force applied to the pushbutton is canceled, the toothed block is reset to be engaged with the guide rod.

Further, a third angle is provided between the connecting rod and the sloping surface, and meanwhile, a fourth angle is provided between the connecting rod and the guide rod, the third angle and the fourth angle enabling the pressing force to which the pushbutton is subject to conquer the friction force between the toothed block and the sloping surface, so that the toothed block is detached from the guide rod.

Further, the third angle and the fourth angle are both less than 90°. Further, the wrench also includes a pushbutton and a connecting rod, the pushbutton, the connecting rod and the toothed block formed into a connecting member provided to be sheathed on the guide rod.

Further, the sliding member is provided with a first portion extending along the guide rod toward the first pawl, and the second pawl is embedded in the first portion.

Further, the sliding member is also provided with a second portion provided to be sheathed on the guide rod, the second portion being provided with a cavity arranged therein, the connecting member being arranged in the cavity.

Further, a portion of the pushbutton is embedded in the cavity, and another portion of the pushbutton protrudes out of the sliding member.

Further, the second pawl is provided with a hang tab embedded in the second portion and fixedly connected to the second portion by a pin rod.

Further, the wrench also includes a clamping surface provided on the first pawl and the second pawl.

Further, the first pawl is connected to the guide rod by a fixing pin arranged with a snap slot used for mounting a snap ring.

Further, a first spring is provided between the first pawl and the guide rod, and when a workpiece is clamped, the first spring can push the first pawl to move, so as to produce pre-tightening force in the workpiece.

Further, the wrench also includes a second spring being able to apply pressing force to the toothed block.

Further, one end of the second spring contacts the toothed block, and the other end contacts a coverplate fixedly connected to the sliding member.

Further, the outside of the sliding member is provided with a first concave part, and the coverplate is embedded in the first concave part, the coverplate fixedly connected to the sliding member by a screw.

Further, the screw is a flat screw, and a gap exists between the screw and the toothed block.

Further, the sliding member is also provided with a thumb abutting part facilitating an operator to push the sliding member to move, a surface of the thumb abutting part is provided with a second stripes, slots parallel to each other being between the second strips, for increasing the friction between the fingers of the operator and the thumb abutting part.

Further, the first spring is a spiral spring.

Further, the pushbutton surface is provided with a first stripes, slots parallel to each other being between the first strips, for increasing the friction between the fingers of the operator and the pushbutton.

Further, the clamping surface is provided with teeth used for increasing the friction between the clamping surface and the clamped workpiece.

Further, the second spring is a compressed spring.

Further, both sides of the guide rod are provided with a recess extending across the whole guide rod, such that, the connecting rod at either side of the guide rod is not in complete contact with the side of the guide rod, facilitating the toothed blocking to slide along the guide rod.

Further, the guide rod is provided with a grasp part which is a protection sleeve surrounding about the guide rod.

Further, the protection sleeve is fixedly connected to the guide rod by a fastener.

Further, the fastener is composed of a nut and a bolt.

Further, the protection sleeve is provided with a second concave part, and the nut is embedded in the second concave part.

Further, the protection sleeve is also provided with a hang hole, used for hangingly position the wrench.

The invention has the following advantages:

(1) By fast sliding movement between the guide rod and the toothed block, the fast adjustment of the jaws, i.e. the distance between the first pawl and the second pawl, can be achieved.

(2) The unidirectional teeth at the engagement portion where the guide rod is engaged with the toothed block have a unidirectional orienting effect. The second pawl is only allowed to move toward but not away from the first pawl when the sliding member is pushed, thus, the second pawl will not automatically move away from the first pawl so that the clamped object is dropped when clamping a workpiece, so that the clamped object is tightly clamped.

(3) By applying a pressing force to the pushbutton, the toothed block can be detached from the guide rod readily, which is good for fast adjustment of the jaws. In addition, when canceling the pressing force to the pushbutton, the elastic force of the second spring can quickly reset the toothed block to be engaged with the guide rod.

(4) The angle between the sloping surface of the sliding member and the direction along the length of the guide rod is arranged to be less than 90°, being able to increase the pressing force between teeth on the toothed block and the teeth on the guide rod, so that the toothed block is better engaged with the guide rod when the wrench is clamping a workpiece.

(5) The angle between the connecting rod and the direction along the length of the guide rod is less than 90°, and the angle between the connecting rod and the sloping surface of the sliding member is less than 90°, so that once an act is applied to the pushbutton the toothed block can readily conquer the friction to slide down along the sloping surface of the sliding member when the wrench is not clamping a workpiece, so that fast detachment of the toothed block from the guide rod and, therefore, unlocking, can be achieved.

(6) The unidirectional teeth on the toothed block and the guide rod have a toothed surface obstructing the sliding movement of the toothed block toward the first pawl. The angle between the toothed surface and the sloping surface of the sliding member is arranged to be more than 0°, such that the toothed block can still be locked and not detached from the guide rod when the wrench is clamping a workpiece even if deformation occurs to the unidirectional teeth.

Referencing now to the figures, the conception, detailed structure and induced technical effect of the present invention will be expounded for due understanding of the purpose, characterizations and effects of the present invention.

DETAILED DESCRIPTION OF THE PREFERRED EMBODIMENTS

Now the invention is further described in combination with the accompanying figures and embodiments.

Figure 1:
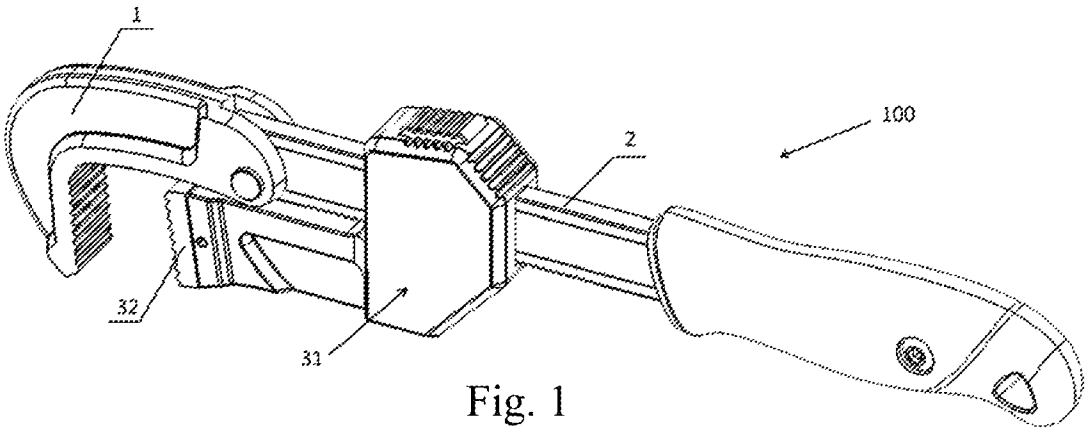
FIG. 1 is a perspective view of the wrench in a preferred embodiment of the invention.
Figure 2:
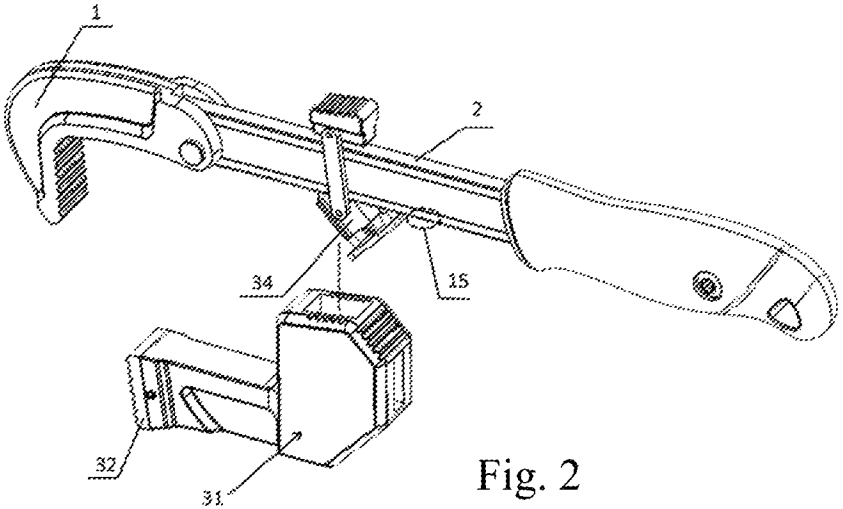
FIG. 2 is another perspective view of the wrench is a preferred embodiment of the invention.

FIG. 1 and FIG. 2 are perspective views of the wrench 100 in a preferred embodiment of the invention, the structure thereof includes: a guide rod 2, a first pawl 1 mounted on the guide rod 2, a sliding member 31 sheathed on the guide rod 2, and a second pawl 32 mounted on the sliding member 31 and matching with the first pawl 32. The wrench also includes a toothed block 34 disposed inside the sliding member 31 and matching with the guide rod 34. The toothed block 34 has a first position and a second position.

The wrench 100 is configured such that: when the toothed block 34 is in the first position, the toothed block 34 is engaged with the guide rode 2, and the toothed block can slide along the guide rod toward the first pawl 1, and is locked in the direction away from the first pawl 1; when the toothed block 34 is in the second position, the toothed block 34 is detached from the guide rod 2, and the toothed block 34 can slide along the guide rod 2 toward or away from the first pawl.

In an embodiment of the invention, the first position refers to a position where the toothed block 34 is located when the toothed block 34 is engaged with the guide rod; the second position refers to a position where the toothed block 34 is located when the toothed block 34 and the guide rod 2 are detached.

As shown in FIG. 2, an engagement portion where the guide rod 2 is engaged with the toothed block 34 is provided with unidirectional teeth 15 having a unidirectional orienting effect: when the sliding member 31 is pushed toward the first pawl 1, the toothed block 34 is slidable along toothed surface of the unidirectional teeth 15, so that the sliding member 31 and the second pawl 32 move along the guide rod 2 and comes close to the first pawl 1; when the sliding member 31 is pushed away from the first pawl 2, a sliding movement of the toothed block 34 along toothed surface of the unidirectional teeth 15 is obstructed, so that the sliding movement of the sliding member 31 and the second pawl 32 along the guide rod 2 is locked.

Figure 3:
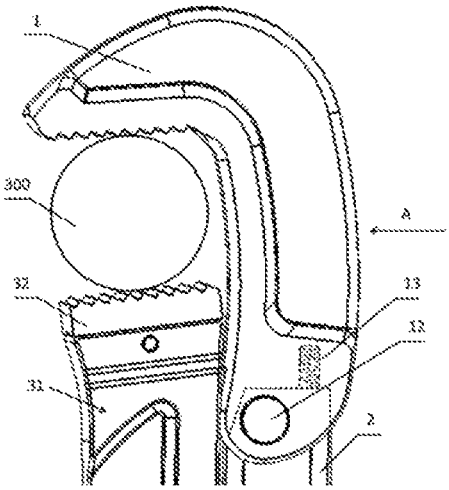
FIG. 3 is perspective view of the connection between the first pawl and the guide rod of the wrench.

As shown in FIG. 3, in the wrench 100 in the preferred embodiment of the invention, the first pawl 1 is pivotedly connected to the guide rod 2 by a fixing pin 12, and the second pawl 32 is fixedly connected to the sliding member 31. The first pawl 1 and the second pawl 32 are matched for clamping workpieces of different shapes like a pipe fitting, a flat plate, a screw. A first spring 13 is also arranged between the first pawl 1 and the guide rod 2. The first spring 13 is a spiral spring. In another embodiment, the first spring 13 can be replaced with an elastic washer. When the first pawl 1 and the second pawl 32 are matched to clamp the workpiece 300, the opening of the jaws enables the first pawl to pivot by a small angle along the opposite direction of the arrow A, where the first spring 13 is compressed, and under the effect of the restoring force, the first spring 13 pushes the first pawl 1 along the direction of arrow A, producing pre-tightening force in the workpiece 300 between the first pawl 1 and the second pawl 32. Because teeth are arranged at the portion where the first pawl 1 and the second pawl 32 clamp the workpiece, under the effect of the pre-tightening force, the teeth compress tightly against the surface of the workpiece 300, so that the slippage will not occur between the teeth and the wrench 100 when in a screwing operation.

Figure 4:
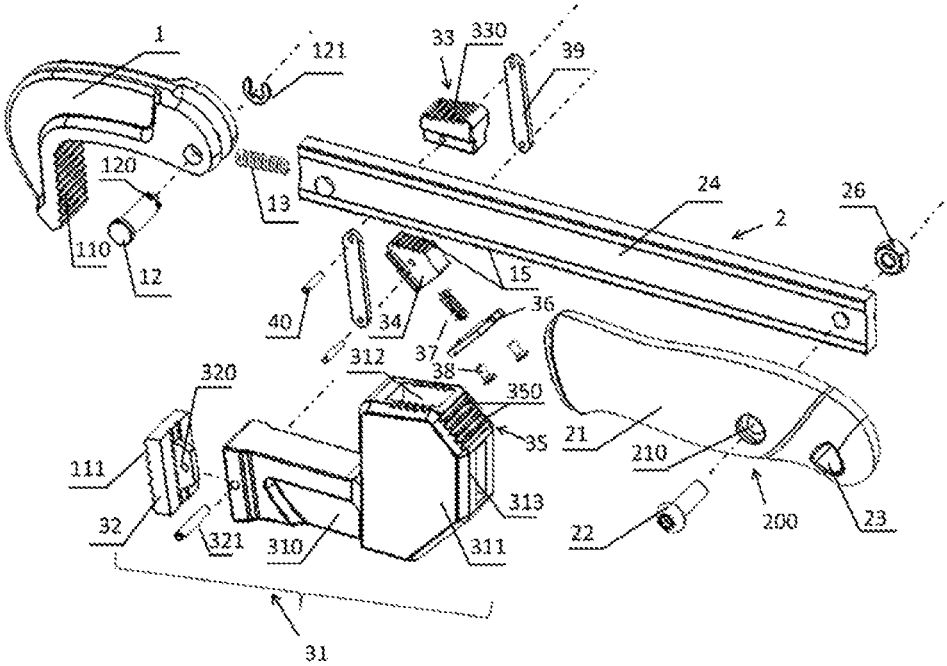
FIG. 4 is an exploded view of the wrench shown in FIG. 1.

As shown in FIG. 4, the wrench 100 includes a guide rod 2, a first pawl 1, a second pawl 32. The guide rod 2 has a grasp part 200, which is a protection sleeve 21 that can be made of materials of leather, plastic, etc. The shape of the protection sleeve 21 is ergonomic. The protection sleeve 21 can be provided to be sheathed on the rod 2 and can be removed from the guide rod 2 readily. The protection sleeve 21 is fixedly connected to the guide rod by a fastener, and preferably, the fastener is a bolt 22 and a nut 26. A hang hole 23 is arranged on the protection sleeve 21. After using the wrench 100, the wrench 100 can be hangingly placed using the hang hole 23. Preferably, the protection sleeve 21 is provided with a second concave part 210 which is perfectly for embedding the bolt 22 thereinto, thus on the one hand, the protection sleeve 21 are made more aesthetic, while in the mean time avoiding the head part of the bolt 22 hurting the fingers of an operator due to being protruding out of the protection sleeve 21.

The first pawl 1 is pivotedly connected to the guide rod 2 by the fixing pin 12. The fixing pin 12 is arranged with a snap slot 120. A snap ring 121 is disposed in the snap slot 120, such that the fixing pin 12 will not fall out from inside the mounting holes of the guide rod 2 and the first pawl 1. A first spring 13 is also arranged between the first pawl 1 and the guide rod 2. As noted above, under the effect of the restoring force of the first spring 13, the first pawl 1 and the second pawl 32 can produce pre-tightening force in the clamped workpiece when clamping a workpiece, so that slippage will not occur to the wrench 100 when in screwing operation.

The wrench body 100 also includes a sliding member 31 including a first portion 310 extending along the lower part of the guide rod 2 toward the first pawl 1, the end part thereof, i.e. the portion close to the first pawl 1 being provided with a slot provided with a second pawl 32 embedded therein. As shown in FIG. 4, a side of the second pawl 32 has a clamping surface 111 matching with the clamping surface 110 of the first pawl. The two clamping surfaces are both arranged with teeth, and the shapes of the teeth can be identical or partly different. The teeth are used for increasing the friction between the two clamping surfaces and the clamped object. The other side of the second pawl 32 is provided with a hang tab 320 embedded in the slot of the first portion 310 of the sliding member 31, and is fixedly connected to the first portion 310 by the pin 321.

Figure 5:
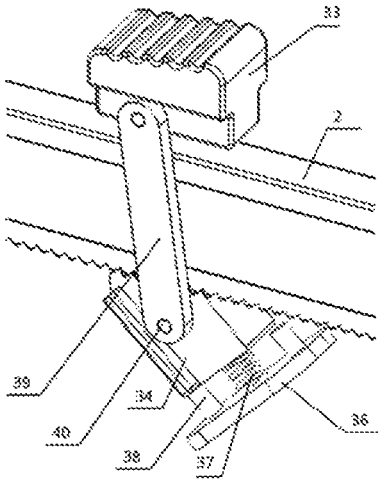
FIG. 5 is a partial enlarged view of FIG. 2.

The sliding member 31 also includes a second portion 311 provided with a cavity 312 arranged therein. A toothed block 34 is arranged inside the cavity 312. The toothed block 34 is coupled to the pushbutton 33 though a connecting rod 39. A pin 40 is used for connection between the connecting rod 39 and the toothed block 34, or the connecting rod 39 and the pushbutton 34. At least two connecting rods 39 are, parallel to each other, connected to the two sides of the pushbutton 33 and the toothed block 34 (see FIG. 5). The connecting member composed of the pushbutton 33, the connecting rod 39 and the toothed block 34 is located in the cavity 312. The guide rod 2 passes through the connecting member and meanwhile passes through the second portion 311. The connecting rods 39 are located at the two sides of the guide rod 2. The pushbutton 33 is located at the upper part of the guide rod 2 and a gap is reserved between the pushbutton 33 and the guide rod 2. The lower part of the guide rod 2 and the upper surface of the toothed block 34 are provided with unidirectional teeth 15. The upper surface of the toothed block 34 is engaged with the lower part of the guide rod 2. A part of the pushbutton is embedded in the cavity 312, and another part is protruding out of the second portion 311 of the sliding member 31.

In a preferred embodiment of the invention, the surface of the pushbutton 33 is arranged with a first stripes 330. Slots parallel to each other are between the first strips 330, which, in another embodiment, can also be staggered slots, for increasing the friction between the fingers of the operator and the pushbutton 33, and preventing slippage when the fingers of the operator contact the pushbutton 33, which tempers using. The two sides of the guide rod 2 are arranged with recesses 24 extending across the whole guide rod 2, such that, the connecting rods 39 at both sides of the guide rod 2 are not in complete contact with the sides of the guide rod 2, to facilitate the fast sliding movement of the toothed block 34 along the guide rod 2.

The outside of the second portion 311 of the sliding member 31 is provided with a first concave part 313 which is communicated with the cavity 312 for embeddingly arranging the coverplate 36 that fixedly connected to the sliding member 31 by a screw 38. Preferably, the screw 38 is a flat screw, that is, its end part is flat. A gap is reserved between the end part of the screw 38 and the toothed block 34. A second spring 37 is arranged between the coverplate 36 and the toothed block 34. The both ends of the spring 37 are respectively in contact with the toothed block 34 and the coverplate 36 (see FIG. 5). The spring 37 applied a pressing force to the toothed block 34, so that the toothed block 34 is engaged with the lower part of the guide rod 2. Preferably, the second spring 37 is a compressed spring.

In addition, the outside of the second portion 311 of the sliding member 31 is also provided with a thumb abutting part 35 facilitating the operator to push the sliding member 31. The surface of the thumb abutting part 35 is provided with a second stripes 350. Slots parallel to each other are between the second strips 350, for increasing the friction between the fingers of the operator and the thumb abutting part 35.

FIG. 6-FIG. 9 provide perspective views of using wrench 100 to implement fast adjustment. When the start position of the second pawl 32 is closed to the grasp part 200 (see FIG. 6), the fingers of the operator can contact the thumb abutting part 35, and apply a push force to the sliding member 31 along the direction of arrow B. Since the engaged portion of the toothed block 34 and the guide rod 2 is provided with unidirectional teeth 15 having unidirectional orienting effect, the toothed block 34 can slide fast along the toothed surface of the unidirectional teeth 15 toward the direction of arrow B, i.e. the direction of the first claw 1. During the sliding movement, the toothed block 34 compresses downwardly the second spring 37, and in return, the second spring 37 holds up the toothed block 34 upwardly so that the toothed block 34 are always in contact with the guide rod 2 and not detached. The fast sliding movement of the toothed block 34 toward the first pawl 1 drives the sliding member 31 so as to drive the second pawl 32 to move fast toward the first pawl 1, so as to achieve the function of fast reducing the opening of the jaws. If the sliding member 31 is pushed along the opposite direction of arrow B, i.e., the direction closing to the grasp part 200, the sliding movement of the toothed block 34 along the toothed surface of the unidirectional teeth 15 is obstructed due to the unidirectional orienting effect of the unidirectional teeth 15, the toothed block 34 thus is locked (see FIG. 7).

Figure 6:
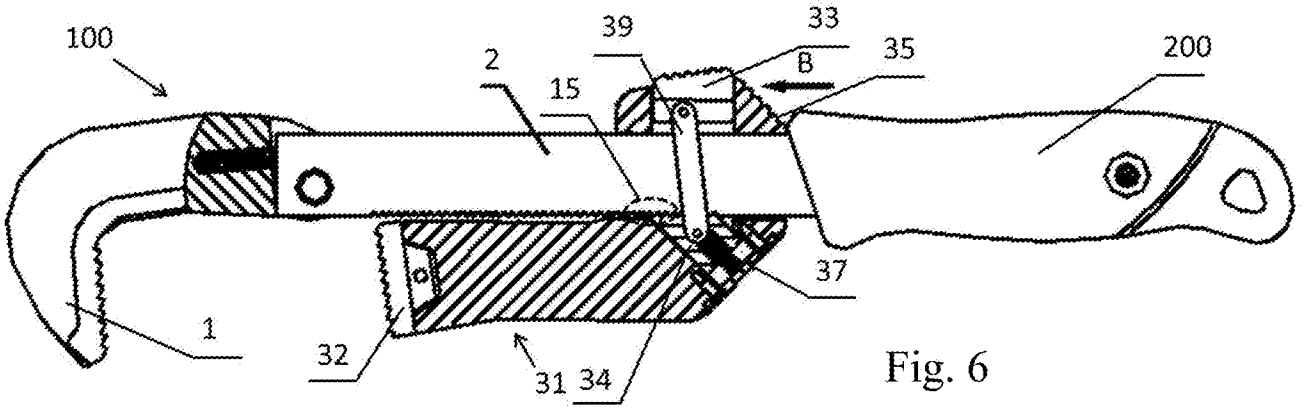
FIG. 6 is a perspective view of the wrench shown in FIG. 1 when the second pawl comes close to the grasp part, showing the pushing direction B.
Figure 7:
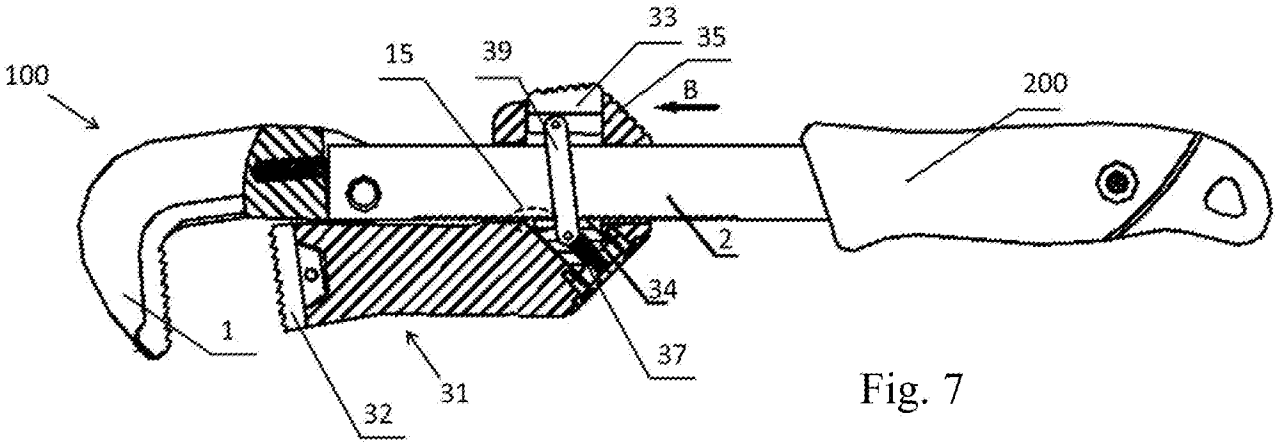
FIG. 7 is a perspective view of the wrench shown in FIG. 1 when the second pawl comes close to the first pawl, showing the pushing direction B.
Figure 8:
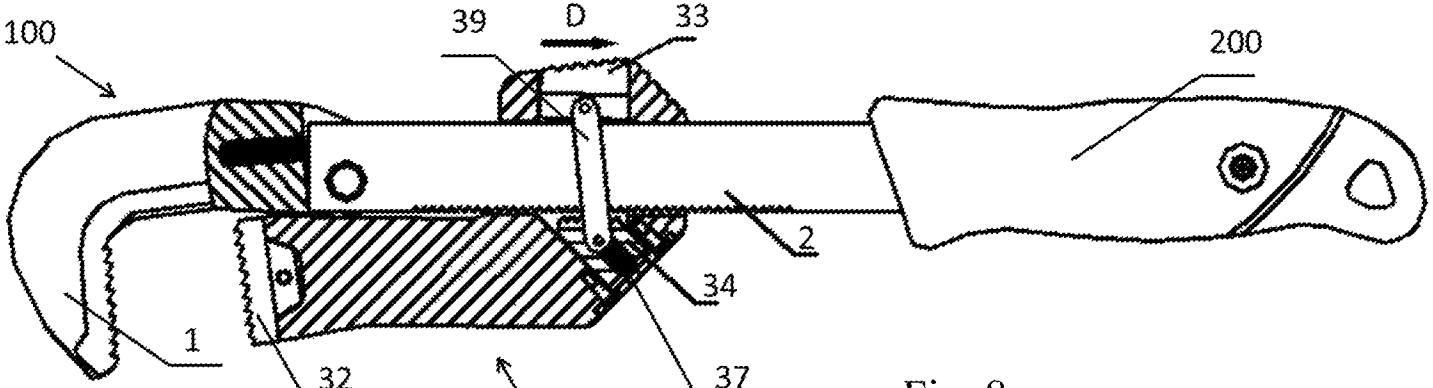
FIG. 8 is a perspective view of the wrench shown in FIG. 1 when the second pawl comes close to the first pawl, showing the pushing direction D.
Figure 9:
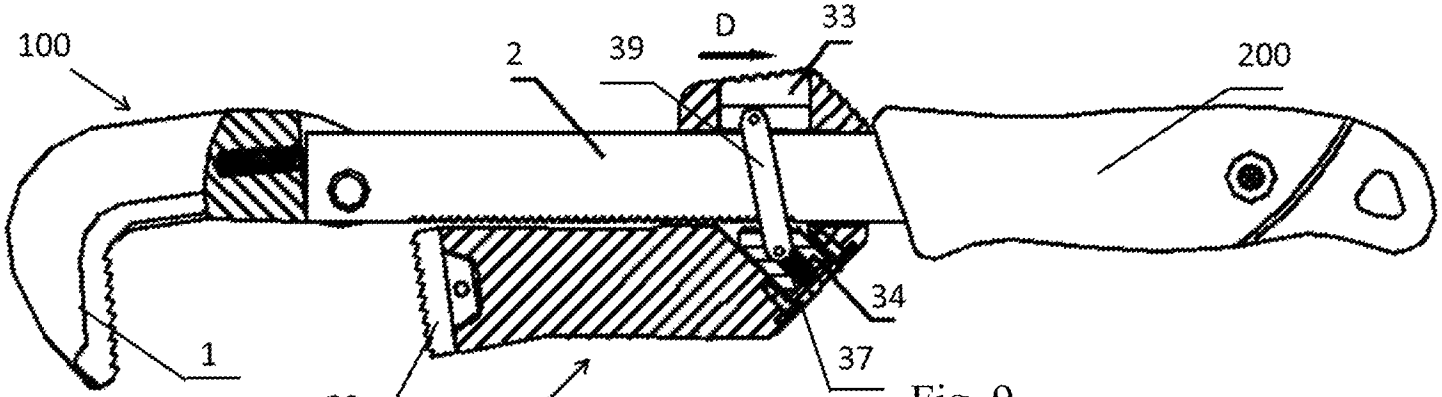
FIG. 9 is a perspective view of the wrench shown in FIG. 1 when the second pawl comes close to the grasp part, showing the pushing direction D.

When the start position of the second pawl is closed to the grasp part 200, as shown in FIG. 6, the fingers of the operator can also be pushed down on the pushbutton 33, i.e., applying pressing force to the pushbutton 33, then the pushbutton 33 presses down the toothed block 34 through the connecting rod 39 and simultaneously the toothed block 34 compresses the second spring 37, so that the toothed block 34 is detached from the guide rod 2, and then pushes the sliding member 31 toward the direction of arrow B, causing the toothed block 34 to slide fast along the guide rod 2 and closing to the first pawl 1, so as to drive the sliding member 31 and the second pawl 32 to move fast toward the first pawl 1, realizing the function of fast reducing the opening of the jaws. When the pressing effect to the pushbutton 33 is cancelled, the toothed block 34 slide upward and reset due to the effect of the elastic force of the second spring 37, so that the toothed block 34 is engaged with the guide rod 2, and at that time the second pawl 32 stops the movement along the guide rod 2.

Figure 10:
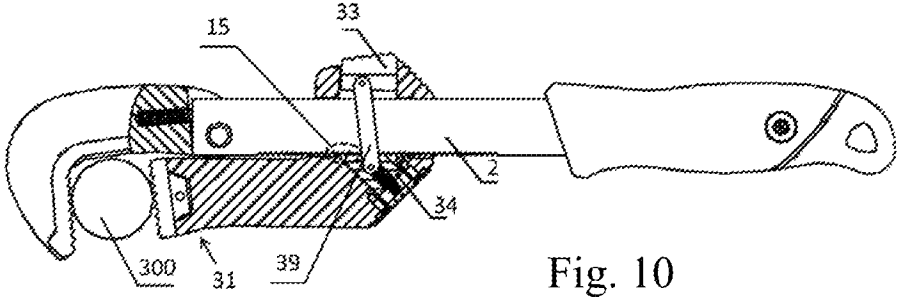
FIG. 10 is a perspective view of the wrench of the invention when clamping a pipe fitting.
Figure 11:
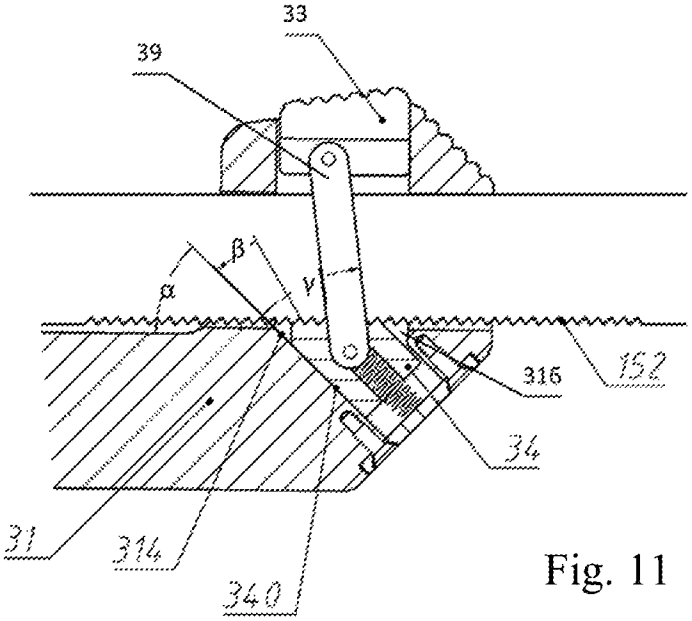
FIG. 11 is a partial enlarged view of FIG. 10.

When the start position of the second pawl 32 is closed to the first pawl 1 (see FIG. 8), the fingers of the operator can be pushed down on the pushbutton 33, i.e., applying pressing force to the pushbutton 33, then the pushbutton 33 presses down the toothed block 34 through the connecting rod 39 and simultaneously the toothed block 34 compresses the second spring 37, so that the toothed block 34 is detached from the guide rod 2, and then pushes the sliding member 31 toward the direction of arrow D, causing the toothed block 34 to slide fast along the guide rod away from the first pawl 1 and towards the grasp part 200, so as to drive the sliding member 31 and the second pawl 32 to move fast away from the first pawl 1, realizing the function of fast increasing the opening of the jaws. When the pressing effect to the pushbutton 33 is cancelled, the toothed block 34 slide upward and reset due to the effect of the elastic force of the second spring 37, so that the toothed block 34 is engaged with the guide rod 2, and at that time the second pawl 32 stops the movement along the guide rod 2 (see FIG. 9). FIG. 10 provides a perspective view of the wrench in a preferred embodiment of the invention when clamping a workpiece 300. FIG. 11 is a partial enlarged view of FIG. 10, showing the angle between the sloping surface 314 of the sliding member 31 and the length direction of the guide rod 2 is a first angle $\alpha$, the angle between the sloping surface 314 and the toothed surface 152 of the unidirectional teeth 15 being a second angle $\beta$, the toothed surface 152 being the surface obstructing the sliding movement of the toothed block 34 along the unidirectional teeth 15. The angle between the sloping surface 314 and the connecting rod 39 is the third angle $\gamma$. The side 340 of the toothed block 34 sticks tightly to the sloping surface 314.

As shown in FIG. 11, when the wrench in the embodiment is clamping the workpiece 300, i.e. the wrench being under a stressed condition, the sliding member 31 applies an upward force perpendicular to the sloping surface 314 to the toothed block 34 through the sloping surface 314. The force is divided to be a upward branch force perpendicular to the guide rod 2 and a branch force along the guide rod to the right (i.e. the direction away from the first pawl 1), in which the upward branch force perpendicular to the guide rod 2 enables the toothed block 34 to be engaged with the guide rod 2, and the branch force along the guide rod 2 to the right enables the toothed block 34 has a tendency of sliding to the right along the guide rod 2. But due to the obstruction effect of the toothed surface 152 of the unidirectional teeth 15, the sliding movement of the toothed block 34 along the guide rod to the right is obstructed, and, therefore, the toothed block 34 is locked on the guide rod 2. In order for the toothed block 34 to be better engaged with the guide rod 2, the angle α is supposed to be decided depending on the friction coefficient between the sloping surface 314 and the toothed block 34, so as to ensure the toothed block 34 to be self-locked and maintained in locking position when being subject to force. The angle α is less than 90° and the lesser the better, which is because the lesser the a is, the larger the upward branch force perpendicular to the guide rod 2, to which the toothed block 34 is subject, so that the larger the pressing force to which the unidirectional teeth 15 are subject, the better the toothed block 34 is engaged with the guide rod 2.

In another aspect, in order to allow realizing reliable locking using friction self-locking between the toothed block 34 and the sloping surface 314, and also realizing fast detachment of the toothed block 34 and the guide rod 2 by conquering the friction self-locking between the toothed block 34 and the sloping surface 314 when pushing down the pushbutton 33. The angle between the connecting rod 39 and the guide rod 2 is a fourth angle, which is arranged to be less than 90° and the angle γ between the connecting rod 39 and the sloping surface 314 γ is less than 90°, such that when pressing down the pushbutton 33, the pushbutton 33 applies a downward force to the toothed block 34 through the connecting rod 39. The force can be divided to be a branch force perpendicular to the sloping surface 314 and a downward branch force parallel to the sloping surface 314. The smaller the angle γ is, the larger downward branch force to which the toothed block 34 is subject, and the branch force perpendicular to the sloping surface 314 is smaller, and the upward friction to which the toothed block 34 is subject is smaller, and the toothed block 34 are more readily to conquer the friction to slide downward along the sloping surface 314 so as to achieve the detachment from the guide rod 2 and to be unlocked.

In order to ensure the wrench of the invention can still lock the toothed block 34 and not let it to be detached from the guide rod 2 when the wrench is under stressed condition and the unidirectional teeth 15 deform, the angle β between the sloping surface 314 and the toothed surface 152 of the unidirectional teeth 15 is arranged to be more than 0°, and the larger the angle β, the more reliable the locking of the toothed block is. But in the mean time it needs to be rotated by an angle to conquer the locking of the toothed block and the guide rod brought by the angle β, so as to detach the teeth on the toothed block 34 and the teeth on the guide rod 2. Therefore a certain space 316 is required to be reserved between the sliding member 31 and the cavity in the cavity 312 to allow the toothed block 34 to rotate in the cavity 312 so as to detach the teeth of the two. Meanwhile, the reserve space 316 can also ensure the plurality of the teeth on the toothed block 34 to automatically find position and reliably come into contact with the guide rod 2 so as to increase the strength between the teeth.

In a preferred embodiment of the invention, α=45°, β=15°, γ=40°.

The foregoing described the preferred embodiments of the present invention. It should be understood that an ordinary one skilled in the art can make many modifications and variations according to the concept of the present invention without creative work. Therefore, any person skilled in the art can get any technical solution through logical analyses, deductions and limited experiments, which should fall in the protection scope defined by the claims.

The invention claimed is:

1. A wrench, comprising: a guide rod, a first pawl mounted on the guide rod, a sliding member sheathed on the guide rod, and a second pawl mounted on the sliding member and matching with the first pawl, wherein the wrench further comprises a toothed block disposed on the sliding member and matching with the guide rod, the toothed block having a first position and a second position;

wherein the sliding member is provided with a sloping surface matching with the toothed block, a first angle being provided between the sloping surface and the guide rod; the first angle enabling the toothed block to be subject to an acting force perpendicular to the guide rod and pointing toward the guide rod when the wrench is clamping a workpiece; and wherein the wrench is configured such that when the toothed block is in the first position, the toothed block is locked; and when the toothed block is in the second position, the toothed block is unlocked.

2. The wrench as claimed in claim 1, wherein the first position refers to a position where the toothed block is located when the toothed block is engaged with the guide rod; the second position refers to a position where the toothed block is located when the toothed block and the guide rod are detached.

3. The wrench as claimed in claim 1, wherein, when the toothed block is in the first position, the toothed block is slidable along the guide rod toward the first pawl, and is locked in the direction away from the first pawl; when the toothed block is in the second position, the toothed block is slidable along the guide rod toward or away from the first pawl.

4. The wrench as claimed in claim 1, wherein an engagement portion where the guide rod is engaged with the toothed block is provided with unidirectional teeth having a unidirectional orienting effect, wherein when the sliding member is pushed toward the first pawl, the toothed block is slidable along a toothed surface of the unidirectional teeth, so that the sliding member moves along the guide rod and comes close to the first pawl; when the sliding member is pushed away from the first pawl, a sliding movement of the toothed block along the toothed surface of the unidirectional teeth is obstructed, so that a sliding movement of the sliding member along the guide rod is locked.

5. The wrench as claimed in claim 1, wherein the first angle is arranged to be less than 90°.

6. The wrench as claimed in claim 1, wherein an engagement portion where the guide rod is engaged with the toothed block is provided with unidirectional teeth having a toothed surface, the toothed surface obstructing the sliding movement of the toothed block away from the first pawl, a second angle being provided between the toothed surface and the sloping surface, the second angle enabling the unidirectional teeth to still be able to lock the toothed block when the unidirectional teeth deform.

7. The wrench as claimed in claim 6, wherein, the second angle is arranged to be greater than 0°.

8. The wrench as claimed in claim 7, wherein a reserved space is arranged between the toothed block and the sliding member, the reserved space enabling the toothed block to rotate by an angle allowing the toothed block to conquer the locking of the toothed block with respect to the guide rod produced due to the second angle, so that the toothed block is detached from the guide rod; meanwhile, the reserved space enabling a plurality of teeth on the toothed block to automatically locate position to be engaged with the guide rod.

9. The wrench as claimed in claim 1, wherein the wrench further comprises a connecting rod connected to the toothed block.

10. The wrench as claimed in claim 9, wherein the wrench further comprises a pushbutton connected to the toothed block by the connecting rod, when a pressing force is applied to the pushbutton, the connecting rod being able to transfer the pressing force to the toothed block, so that the toothed block is detached from the guide rod; when the pressing force applied to the pushbutton is canceled, the toothed block being able to reset to be engaged with the guide rod.

11. The wrench as claimed in claim 10, wherein a third angle is provided between the connecting rod and the sloping surface, and meanwhile, a fourth angle is provided between the connecting rod and the guide rod, the third angle and the fourth angle enabling the pressing force to which the pushbutton is subject to conquer the friction force between the toothed block and the sloping surface, so that the toothed block is detached from the guide rod.

12. The wrench as claimed in claim 11, wherein the third angle and the fourth angle are both arranged to be less than 90°.

13. The wrench as claimed in claim 1, wherein the wrench further comprises a pushbutton and a connecting rod, the pushbutton, the connecting rod and the toothed block forming into a connecting member provided to be sheathed on the guide rod.

14. The wrench as claimed in claim 13, wherein the sliding member is provided with a first portion extending along the guide rod toward the first pawl, and the second pawl is embedded in the first portion.

15. The wrench as claimed in claim 14, wherein a portion of the pushbutton is embedded in the cavity, and another portion of the pushbutton protrudes out of the sliding member.

16. The wrench as claimed in claim 14, wherein the second pawl is provided with a hang tab embedded in the second portion and fixedly connected to the second portion by a pin rod.

17. The wrench as claimed in claim 16, wherein the wrench further comprises a clamping surface provided on the first pawl and the second pawl.

18. The wrench as claimed in claim 13, wherein the sliding member is further provided with a second portion provided to be sheathed on the guide rod, the second portion being provided with a cavity arranged therein, the connecting member being arranged in the cavity.

19. The wrench as claimed in claim 1, wherein the first pawl is connected to the guide rod by a fixing pin arranged with a snap slot used for mounting a snap ring.

20. The wrench as claimed in claim 1, wherein the wrench further comprises a second spring being able to apply pressing force to the toothed block.

21. The wrench as claimed in claim 20, wherein one end of the second spring contacts the toothed block, and the other end contacts a coverplate fixedly connected to the sliding member.

22. The wrench as claimed in claim 21, wherein the outside of the sliding member is provided with a first concave part, and the coverplate is embedded in the first concave part, the coverplate being fixedly connected to the sliding member by a screw.

23. The wrench as claimed in claim 1, wherein the sliding member is further provided with a thumb abutting part facilitating an operator to push the sliding member to move.

* * * * *